US009167368B2

(12) United States Patent
De Jong et al.

(10) Patent No.: US 9,167,368 B2
(45) Date of Patent: Oct. 20, 2015

(54) EVENT NOTIFICATION ON A MOBILE DEVICE USING BINAURAL SOUNDS

(75) Inventors: Janice Leigh De Jong, Kitchener (CA); Jerome Pasquero, Kitchener (CA); Jason Tyler Griffin, Kitchener (CA); Scott David Reeve, Waterloo (CA)

(73) Assignee: BlackBerry Limited, Waterloo, Ontario (CA)

( * ) Notice: Subject to any disclaimer, the term of this patent is extended or adjusted under 35 U.S.C. 154(b) by 894 days.

(21) Appl. No.: 13/336,771

(22) Filed: Dec. 23, 2011

(65) Prior Publication Data

US 2013/0163765 A1 Jun. 27, 2013

(51) Int. Cl.
*H04R 5/02* (2006.01)
*H04S 7/00* (2006.01)

(52) U.S. Cl.
CPC ..... *H04S 7/304* (2013.01); *H04S 2400/11* (2013.01); *H04S 2420/01* (2013.01)

(58) Field of Classification Search
CPC ..... H04R 25/552; H04S 2420/01; H04S 2400/11; H04S 2420/11; G06F 3/16; G10L 13/043; G10L 19/04
USPC ..... 381/17, 56, 58, 61, 26, 309, 310
See application file for complete search history.

(56) References Cited

U.S. PATENT DOCUMENTS

2002/0147586 A1* 10/2002 Belrose ..... 704/233
2002/0150254 A1* 10/2002 Wilcock et al. ..... 381/1
2002/0150256 A1* 10/2002 Belrose et al. ..... 381/17
2002/0150257 A1* 10/2002 Wilcock et al. ..... 381/17
2002/0151997 A1* 10/2002 Wilcock et al. ..... 700/94
2003/0095668 A1* 5/2003 Wilcock et al. ..... 381/56
2003/0095669 A1* 5/2003 Belrose et al. ..... 381/56
2003/0227476 A1* 12/2003 Wilcock et al. ..... 345/727
2004/0120506 A1 6/2004 Boyd et al.
2005/0117762 A1 6/2005 Sakurai et al.
2006/0018497 A1* 1/2006 Kornagel ..... 381/315
2006/0072764 A1 4/2006 Mertens et al.
2006/0120533 A1 6/2006 Chen
2007/0014280 A1 1/2007 Cormier et al.
2007/0213858 A1* 9/2007 Hatano ..... 700/94
2007/0230736 A1* 10/2007 Boesen ..... 381/380
2008/0008342 A1* 1/2008 Sauk ..... 381/315

(Continued)

OTHER PUBLICATIONS

Examination Report dated Dec. 12, 2013 for European Application No. 11195622.3.

(Continued)

*Primary Examiner* — Xu Mei
(74) *Attorney, Agent, or Firm* — Jon Gibbons; Fleit Gibbons Gutman Bongini & Bianco P.L.

(57) ABSTRACT

In one example, information is presented to a user through an electronic device in a non-visual manner. In this example, an informational event is received. Next, a determination is made if the informational event has been previously associated with a binaural sound sequence, the binaural sound sequence includes a user's nominal ear spacing for sound localization in a 3D space. The binaural sound sequence is presented to a multimedia port, in response to a binaural sound sequence being previously associated with the event. The localization in the 3D space using a binaural sound can be associated with importance, future times, source of information associated with the event, a person associated with the event, or a combination thereof.

20 Claims, 10 Drawing Sheets

(56) References Cited

U.S. PATENT DOCUMENTS

| | | | | |
|---|---|---|---|---|
| 2008/0046246 | A1* | 2/2008 | Goldstein et al. | 704/258 |
| 2008/0086308 | A1* | 4/2008 | Kindo et al. | 704/270.1 |
| 2008/0090659 | A1* | 4/2008 | Aguilar et al. | 463/42 |
| 2009/0052703 | A1* | 2/2009 | Hammershoi | 381/310 |
| 2009/0292544 | A1* | 11/2009 | Virette et al. | 704/501 |
| 2009/0316939 | A1* | 12/2009 | Matsumoto et al. | 381/302 |
| 2010/0146409 | A1* | 6/2010 | Yoshida et al. | 715/757 |
| 2011/0115626 | A1* | 5/2011 | Goldstein et al. | 340/540 |
| 2011/0119063 | A1* | 5/2011 | Arnison | 704/275 |
| 2011/0173539 | A1* | 7/2011 | Rottler et al. | 715/727 |
| 2011/0238419 | A1* | 9/2011 | Barthel | 704/251 |
| 2011/0280388 | A1* | 11/2011 | Kindo et al. | 379/202.01 |
| 2012/0114130 | A1* | 5/2012 | Lovitt | 381/73.1 |
| 2012/0150542 | A1* | 6/2012 | Ma | 704/258 |
| 2012/0213375 | A1* | 8/2012 | Mahabub et al. | 381/17 |
| 2012/0213393 | A1* | 8/2012 | Foo et al. | 381/315 |
| 2013/0158993 | A1* | 6/2013 | Wilcock et al. | 704/235 |

OTHER PUBLICATIONS

Examiner's Report dated May 8, 2014 for Canadian application No. 2,799,045.

EESR dated Jul. 16, 2012 for EP 11195622.

Sawhney, N., et al: "Nomadic Radio: Speech and Audio Interaction for Contextual Messaging in Nomadic Environments," ACM Transactions on Computer-Human Interaction, ACM, New York, NY, US, vol. 7, No. 3, Sep. 1, 2000 pp. 353-383, XP001003176, ISSN: 1073-0516, DOI: 10.1145.355324.355327.

Various: "Head-Related Transfer Function," Wikipedia, Dec. 7, 2011, XP002678919, retrieved from the internet: url: http://en.wikipedia.org/w/index.php?title=Head-related_transfer_function&oldid=464637059.

Various: "Binaural recording," Wikipedia, Dec. 11, 2011, XP002678920, retrieved from the Internet: URL:http://en.wikipedia.org/w/index.php?title=Binaural_recording&oldid=465311960.

Aki Harma et al., "Augmented Reality Audio for Mobile and Wearable Appliances," JAED, AES, 60 East 42nd Street, Room 2520, New York 10165-2520, USA, vol. 52, No. 6, Jun. 1, 2004, pp. 618-639, XP040507102.

Karjalainen Matti et al., "Application Scenarios of Wearable and Mobile Augmented Reality Audio," AES Convention 116; May 2004, AES, 60 East 42nd Street, Room 2520, New York 10165-2520, USA, May 1, 2004, XP040506851.

* cited by examiner

| | 1202 | 1204 | 1206 | 1208 | 1210 | 1212 | 1214 | 1216 | 1218 | 1220 | 1222 | |
|---|---|---|---|---|---|---|---|---|---|---|---|---|
| | APPLICATION ASSOCIATION | TYPE OF BINAURAL 3D IMAGE | START POSITION OR MINIMUM | STOP POSITION OR MAXIMUM | CIRCULAR STARTING REFERENCE OR 12 POSITION | USE LAYERING | LAYER 1 | LAYER 2 | LAYER N | ASSOCIATE PEOPLE TO POSITION | BINAURAL SOUND SOURCE | •...•...• |
| 1250 | BATTERY POWER | LINEAR | BEHIND | IN-FRONT | N/A | NO | N/A | N/A | N/A | N/A | DEFAULT | •...•...• |
| 1252 | WIRELESS STRENGTH | CIRCULAR | 1 | 11 | N/A | NO | N/A | N/A | N/A | N/A | TYPE 1 | •...•...• |
| 1254 | TIME OF DAY | CIRCULAR | N/A | N/A | FRONT | YES | N/A | N/A | N/A | N/A | TYPE 4 | •...•...• |
| 1256 | MEETING REMINDER | CIRCULAR | N/A | N/A | FRONT | NO | N/A | N/A | N/A | N/A | TYPE 7 | •...•...• |
| 1258 | PREDICTIVE SEARCH | CIRCULAR | N/A | N/A | FRONT | NO | | | N/A | N/A | TEXT-TO-SPEECH | •...•...• |
| 1260 | COMBINED | CIRCULAR | N/A | N/A | N/A | YES | MUSIC | EMAIL | MESSAGING | N/A | TYPE 18 | •...•...• |
| 1262 | CALENDAR | CIRCULAR | N/A | N/A | N/A | YES | IMMINENT | SOON | FUTURE | N/A | TYPE 1 | •...•...• |
| 1264 | MESSAGING | CIRCULAR | N/A | N/A | N/A | YES | CRITICAL | IMPORTANT | NORMAL | N/A | TYPE 6 | •...•...• |
| 1266 | EMAIL | CIRCULAR | N/A | N/A | N/A | YES | EMAIL | N/A | N/A | JOHN TO 12 | TYPE 11 | •...•...• |
| 1268 | EMAIL | CIRCULAR | N/A | N/A | N/A | YES | EMAIL | N/A | N/A | JILL TO 9 | TYPE 1 | •...•...• |
| 1270 | MESSAGING | CIRCULAR | N/A | N/A | N/A | YES | N/A | MESSAGING | N/A | JOHN TO 12 | TYPE 9 | •...•...• |
| 1272 | MESSAGING | CIRCULAR | N/A | N/A | N/A | YES | N/A | MESSAGING | N/A | JILL TO 9 | TYPE 9 | •...•...• |
| 1274 | TELEPHONE | CIRCULAR | N/A | N/A | N/A | YES | N/A | N/A | TELEPHONE | JOHN TO 12 | TYPE 13 | •...•...• |
| 1276 | TELEPHONE | CIRCULAR | N/A | N/A | N/A | YES | N/A | N/A | TELEPHONE | JILL TO 9 | TYPE 13 | •...•...• |
| | | | | ⋮ | | | ⋮ | | ⋮ | | | |

FIG. 12

EVENT NOTIFICATION ON A MOBILE DEVICE USING BINAURAL SOUNDS

FIELD OF THE DISCLOSURE

The present disclosure generally relates to electronic devices, and more particularly to presenting information to a user on a wireless communication device.

BACKGROUND

Information is generally presented to a user on an electronic device, such as a wireless communication device, in a visual manner. Stated differently, information is displayed to a user via the display of the device. However, there are many instances where a user is not able to look at the display long enough to fully comprehend the information being displayed. In other instances, users do not want to pull out a device from his/her pocket or holster. At other times, a user may simply be unable to view the display (e.g., while driving). This operation is time-consuming and disruptive. Some electronic devices allow information on the display to be read back to the user using text-to-speech software. However, this text-to-speech option is usually slow and sometimes incomprehensible. Moreover, oftentimes users listen to audio by wearing earphones while on-the-go or while working. Users want to be presented with the information in a more discreet and unobtrusive manner.

BRIEF DESCRIPTION OF THE DRAWINGS

The accompanying figures where like reference numerals refer to identical or functionally similar elements throughout the separate views, and which together with the detailed description below are incorporated in and form part of the specification, serve to further illustrate various examples and to explain various principles and advantages all in accordance with the present disclosure, in which:

FIG. 12 is a table of various binaural sound presentation profiles that are used by the binaural presentation manager in FIG. 1.

DETAILED DESCRIPTION

Figure 1:
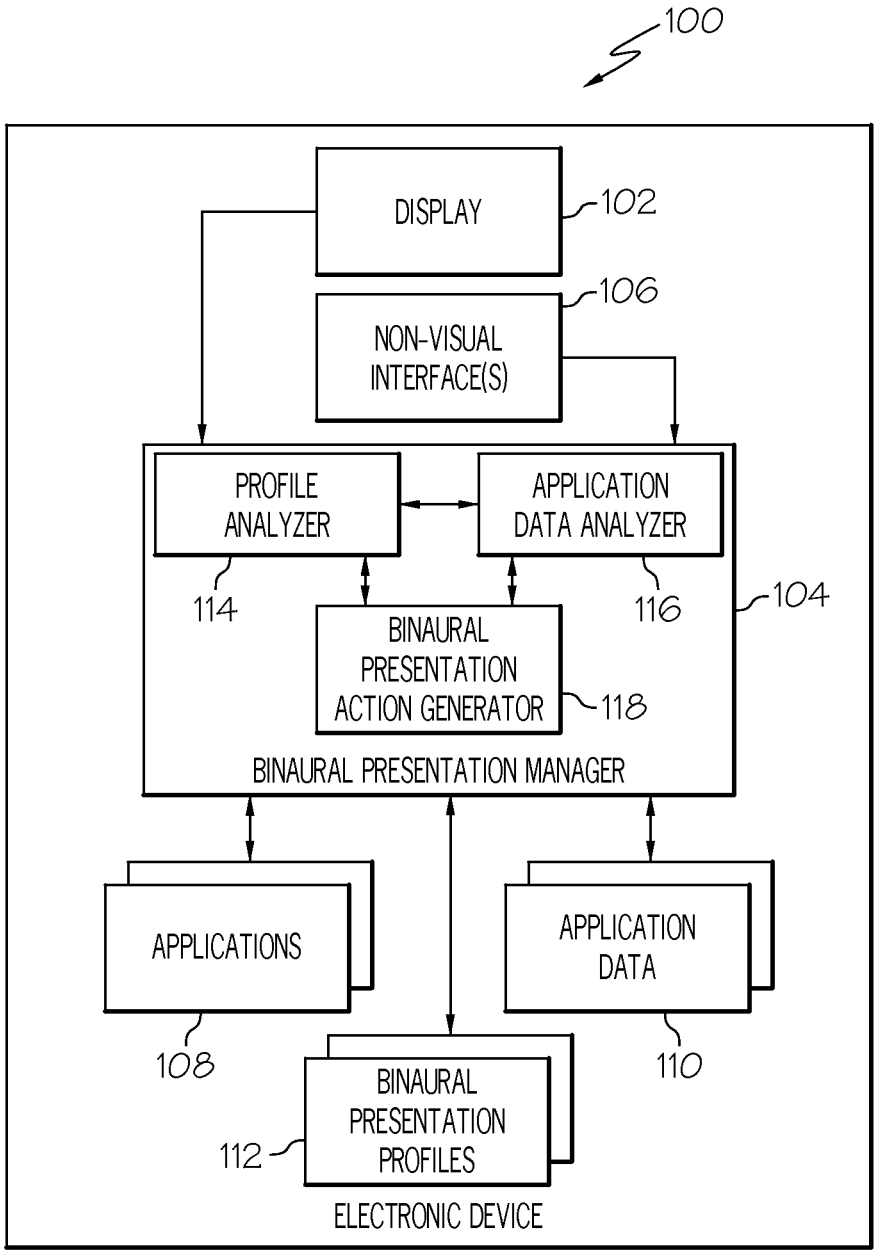
FIG. 1 is a block diagram illustrating one example of an operating environment for presenting information to a user of an electronic device with sound localization in a 3D space using binaural sounds.

As required, detailed embodiments are disclosed herein. However, it is to be understood that the disclosed embodiments are merely examples and that the systems and methods described below can be embodied in various forms. Therefore, specific structural and functional details disclosed herein are not to be interpreted as limiting, but merely as a basis for the claims and as a representative basis for teaching one skilled in the art to variously employ the disclosed subject matter in virtually any appropriately detailed structure and function. Further, the terms and phrases used herein are not intended to be limiting, but rather, to provide an understandable description.

The terms "a" or "an", as used herein, are defined as one or more than one. The term plurality, as used herein, is defined as two or more than two. The term another, as used herein, is defined as at least a second or more. The terms "including" and "having" as used herein, are defined as comprising (i.e. open language). The term "coupled" as used herein, is defined as "connected" although not necessarily directly, and not necessarily mechanically.

Binaural recording is a method of recording sound that uses a special microphone arrangement and is intended for replay using headphones. Dummy head recording is a specific method of capturing the audio, generally using a bust that includes the cartilaginous projection portion of the external ear known as the pinnae or pinnas. Because each person's pinnae are unique, and because the filtering they impose on sound directionality is learned by each person from early childhood, the use of pinnae during recording are not the same, as the ultimate listener may lead to perceptual confusion.

The term "binaural" is not the same as stereo. Conventional stereo recordings do not factor in natural ear spacing or "head-shadow" of the head and ears, since these things happen naturally as a person listens, generating their own interaural time differences (ITDs) and interaural level differences (ILDs). As a general rule, for true binaural results, an audio recording and reproduction system chain, from microphone to listener's brain, should contain one and only one set of pinnae, preferably the listener's own, and one head-shadow. The terms earphones and headphones are used interchangeably as a pair of small loudspeakers held close to a user's ears or in the case of earphones placed in-ear and connected to a signal source on a device. They are also known as stereophones or headsets.

The term "electronic device" is intended to broadly cover many different types of devices that can wirelessly receive signals, and in most cases can transmit signals, and may also operate in a wireless communication system. For example, and not for any limitation, a wireless communication device can include any one or a combination of the following: a two-way radio, a cellular telephone, a mobile phone, a smartphone, a two-way pager, a wireless messaging device, a laptop/tablet/computer, a personal digital assistant, and other similar devices.

Described below are systems and methods using binaural feedback to simulate sound coming from different locations around the user. Disclosed are various ways to deliver useful information through audio medium while users are on the go and are listening to music through their earphones. Spatial properties of sound are used to communicate contextual information in a minimally-obtrusive fashion. Binaural sound also referred throughout this description as a binaural sound sequence can be presented alone or simultaneously while visual feedback can provide a richer multimodal experience. Moreover, binaural sound works well with visually impaired users. Unlike text-to-speech or other methods to present information to a user, information presented with binaural sounds is often ambient information. Ambient information is information that usually lies at the border between the user's consciousness and subconsciousness and does not require active effort from a user. In this case, binaural feedback can be used to communicate to the user subtle cues that she/he might want to attend to or not.

Binaural Device Functional Diagram

FIG. 1 is a block diagram illustrating one example of an operating environment for presenting information to a user of an electronic device with sound localization in a 3D space using binaural sounds. In particular, FIG. 1 shows an electronic device such as, but not limited to, a wireless communication device 100. It should be noted that although the following discussion uses a wireless communication device as one example of an electronic device, any electronic device that presents information to a user is applicable to one or more examples described herein. The wireless communication device 100 comprises, among other things, a display 102, a binaural presentation manager 104, applications 108, application data 110, and binaural presentation profiles 112. The applications 108 can be any application that generates information to be displayed to a user via the display 102. For example, the applications 108 can include, but are not limited to, a messaging application, a global positioning satellite (GPS) application, a calendar application, a clock, a gauge, such as power or wireless signal strength, and more.

The application data 110 comprises data/information generated or managed by the applications 108 typically displayed to the user via the display 102. For example, with respect to a messaging application, the application data 110 can include text messages, email messages, and information associated therewith. With respect to a GPS application, the application data 110 can include routing information/instructions or other related information. With respect to a calendar application, the application data 110 can include meeting/scheduling information and other related information. It should be noted that the application data 110 can also include data that is not necessarily visually displayed to a user, but rather is used by an application to visually display information associated therewith. It should also be noted that the application data 110 is not required to be currently displayed for the binaural presentation manager 104 to analyze the data. The binaural presentation manager 104 can analyze the application data 110 in a non-displayed state. The binaural presentation profiles 112 identify sound localizations in 3D space using binaural sounds to be played by the binaural presentation manager 104 for a given set of application data 110. The binaural presentation profiles 112 are discussed in greater detail below.

The binaural presentation manager 104 comprises a profile analyzer 114, an application data analyzer 116, and a binaural presentation action generator 118. The binaural presentation manager 104 utilizes these components to identify the information that is being presented on the display 102 (and any additional information outside of the display area) and to generate binaural sounds with sound localization in 3D space. The sound localizations are used to present information to the user in a binaural manner via headphones electrically coupled to an output jack or wirelessly coupled to the device 100 though an output port. The binaural presentation manager 104 and its components are discussed in greater detail below.

The sound localization in a 3D space using binaural sounds represents information from the wireless communication device 100. This information on the device may or may not be the same information currently being displayed. In addition, binaural sounds can also be generated to create a pre-view or an overview of information that is outside of the display area (e.g., not currently being displayed).

Binaural Information Used to Pinpoint Location

Binaural navigation beacons are used to pinpoint a location. Two examples are discussed for a fixed point target and a moving target. Each of these examples is now discussed in turn. In these examples, the user head orientation with respect to the user's body is assumed to be straight ahead. In other examples, the position of the head with respect to the body can be tracked and the binaural navigation automatically compensated to user's current head orientation. A tracking sensor, such as a magnetometer or compass can be tied into the headphones of the device the user is wearing.

Figure 2A:
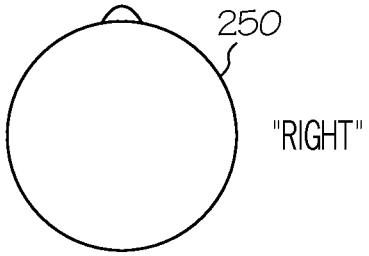
FIGS. 2A-2C are a series of sound localizations in a 3D space using binaural sounds to denote "right", "left", and "straight" for a fixed target.
Figure 2B:
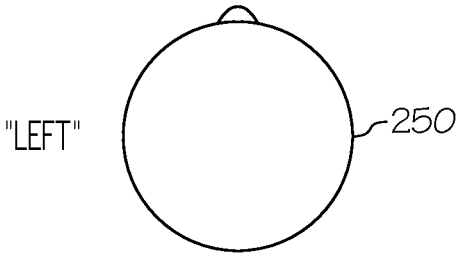
Figure 2C:
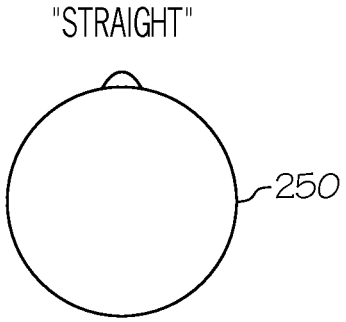

Turning to FIGS. 2A-2C, a series of sound localization is shown as distinct points in a 3D space around a user 250 using binaural sounds to denote "Right", "Left", and "Straight" for a fixed target. These binaural sounds can be words or sounds to provide sound localization in sound axis substantially perpendicular to the head of the user 250. This example is a turn-by-turn example used with wireless phones and GPS units. Other techniques include a beacon in 3D space associated with a desired target or destination. The binaural localization in 3D space is not only for direction, but how far a user is from the target. This distance is further described below.

In another example, points of interest beacons in a room or setting can be identified using positioning sensors such as GPS, magnetometers, compasses. These beacons can indicate objects or people of interest. For example, a location beacon is produced to localize the object in 3D space to attract the user's attention to a particular art piece in a museum during an audio tour.

The use of sound localizations in a 3D space using binaural sounds can be used for moving targets as well. For example, binaural sounds can be used to track moving targets such as taxi cabs, buses, trains and/or emergency vehicles. Through an applet, application or other service, the position of the vehicle is given to the user. The localization of the vehicle in 3D space is not only for direction, but how far a vehicle is currently from a user. This localization is illustrated further in the figures below for various user interface controls.

Using location-based services or social networking services, a binaural sound is associated with the location of a friend. This is useful in many scenarios. For example, when walking in a crowded city, a user may be in close proximity with some of his or her friends without being aware of the proximity. Binaural audio signals pinpoint the user's friends in a moving crowd.

User Interface Control Interactions

Figure 3A:
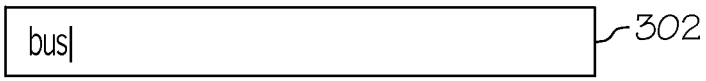
FIGS. 3A-3C illustrate sound localization in a 3D space using binaural sounds to present search results from a predictive search algorithm.
Figure 3B:
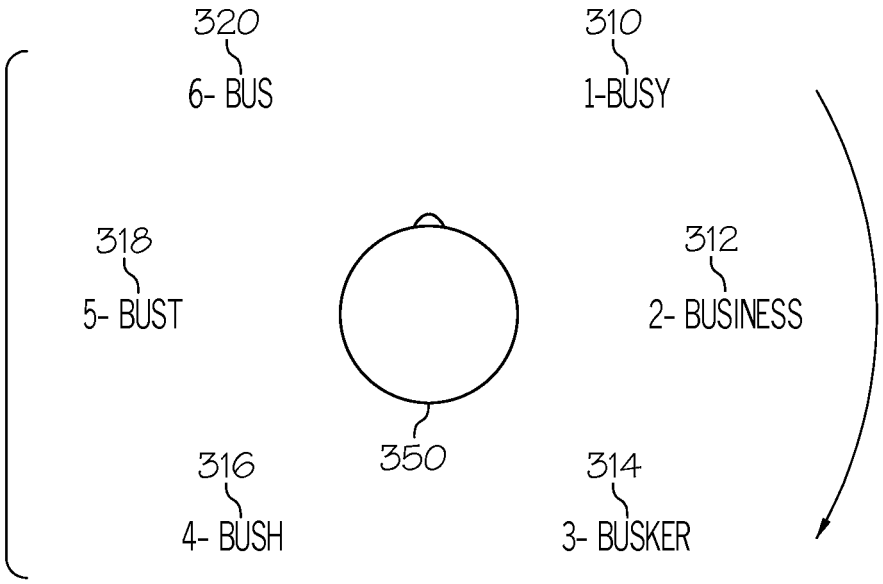
Figure 3C:
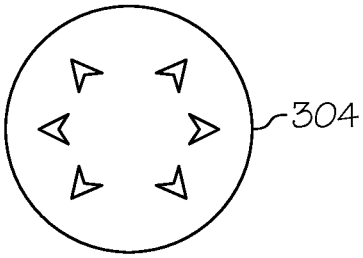

FIGS. 3A-3C illustrate sound localization in a 3D space using binaural sounds to indicate changing a setting on the device or making a selection. Shown is an eyes-free menu presentation. One example of eyes-free menu presentation are results from a predictive algorithm, such a search algorithm with the letters "bus" entered into a search box 302 as shown in FIG. 3A. Entering text into a search box can be via keyboard input, cursor selections of menus, and/or voice recognition technologies. Typically predicative search results are displayed to a user through a user graphical interface. However, in this example, as shown in FIG. 3B, search matches are presented using binaural sounds and localized in a 3D space surrounding the user 350. In this example, results are played using binaural sounds around the user's head 350 in sequence. Specifically, the results 310 "busy", 312 "business", 314 "busker", 316 "bush", 318 "bust", 320 "bus" are played with binaural sounds in a 3D space surrounding a user's head 350. The user points to the desired result by pointing with a selection device 304, such as a mouse, trackball, or joystick, as shown in FIG. 3C. It is important to note that other examples to provide information to a user in addition to results from a predictive algorithm have been shown to be used advantageously with the binaural sound. For example, predictive algorithms may be based solely on matching a partial string input from a user with dictionary entries or use predictive text technologies such as Research In Motion's SURETYPE™ system, or be based on using a combination of both. Predictive text systems often use word disambiguation techniques that make it easier to type text messages. Some of these systems provide a sequence of word suggestions. Other systems allows words to be entered by a single keypress for each letter, as opposed to the multi-tap approach used in the older generation of mobile devices in which several letters are associated with each key, and selecting one letter often requires multiple keypresses.

The SURETYPE™ system combines the groups of letters on each phone key with a fast-access dictionary of words. The system looks up in the dictionary all words corresponding to the sequence of keypresses and orders them by frequency of use. As predictive text technologies gains familiarity with the words and phrases the user commonly uses, the system speeds up the process by offering the most frequently used words first and then lets the user access other choices with one or more presses of a predefined "next" key. Predictive text systems have initial, linguistic settings that offer predictions that are re-prioritized to adapt to each user. This learning adapts, by way of the device memory, to a user's disambiguating feedback which results in corrective key presses, such as pressing a "next" key to get to the intention. Most predictive text systems have a user database to facilitate this process.

Figure 4:
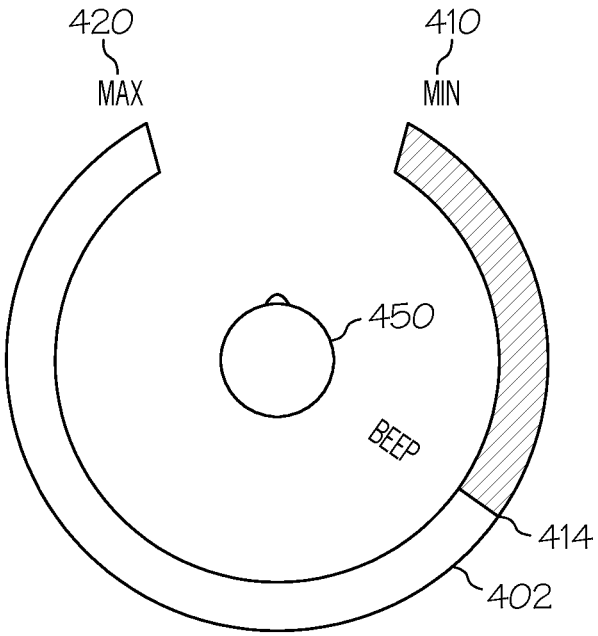
FIG. 4 illustrates concentric sound localization in a 3D space using binaural sounds associated with a circular gauge.

For example, the concept of sound localization using binaural sounds in a 3D space as a circular gauge to a user as shown in FIG. 4. In this example, a gauge 402 indicates the battery level or amount of battery capacity left or wireless signal strength or other measured or measurable quantity with a minimum value and a maximum value. Other measurable quantities typically used for gauges include speaker volume, display settings, number of new e-mail/text messages, hardware capacity such as disk space, processor speed, memory usage, and more. Binaural sound, presented concentrically around a user's head as shown, is used to indicate the position or level of a gauge.

FIG. 4 illustrates a circular gauge 402 projected with concentric sound localization in a 3D space using binaural sounds around a user 450. The gauge 402 has a minimum value 410 played with a binaural sound at the 1 o'clock position and a maximum value 420 played with a binaural played at the 11 position o'clock, and the current position or level of the gauge 402 is somewhere in between at a position 414. In one example, a binaural sound reference for a minimum value 410 and a maximum value 420 are played. Next, a separate binaural sound is played to indicate the current level or position 414 between the minimum value 410 and maximum value 420. The current position could be a sequence of sounds starting from the minimal value 410 around to position 414 or just the position 414 itself. In another example, the minimal and maximal binaural sounds are not played prior to the current position 414. The position of minimal and maximal sound in a presentation profile can be set by the user as described with more detail below.

Figure 5:
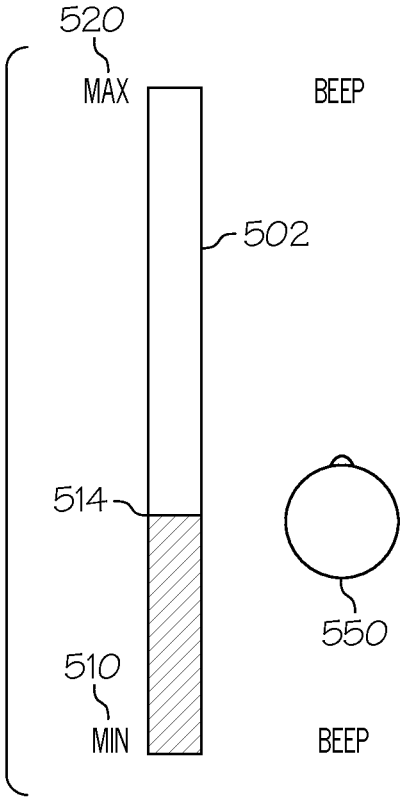
FIG. 5 illustrates sound localization in a 3D space using binaural sounds associated with a linear gauge.

Next, illustrated is sound localization in a 3D space using binaural sounds to represent a linear gauge 502 shown in FIG. 5. In this example, the maximum value 520 is played in front of the user 550 and minimum value 510 is played behind the user 550. The distance that the user perceives between himself/herself and these two sources 510 and 550 define the length of the gauge 502. The current position 514 is an indicative gauge value. As described in the circular gauge example, the binaural sound associated with the current position 514 can be played after the minimal 510 and maximal 520 binaural sounds or played individually and independently. Again this type of preference is user settable.

Figure 6:
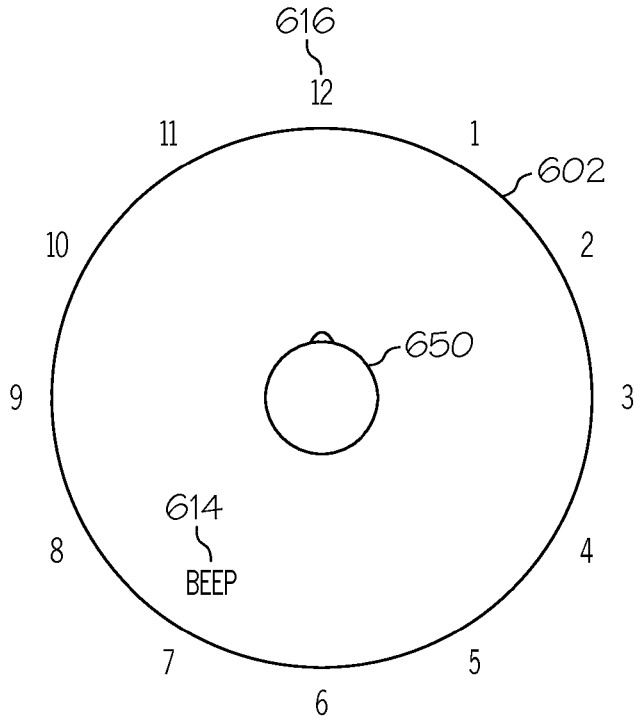
FIG. 6 illustrates sound localization in a 3D space using binaural sounds associated with a clock.

Although circular and linear gauges can be extended to cover time and dates, the following expands on the representation of time and calendar functions using sound localization in a 3D space using binaural sounds. FIG. 6 illustrates a representation of a clock 602. Instead of a voice that explicitly reads the time out loud, time is represented with an abstraction that recalls a clock. For instance, the source of an audio signal in relation to the user can indicate the position 614 of the small hand or hour hand of a clock. A position 616 of the large hand or minute hand is also indicated using binaural sounds.

Figure 7:
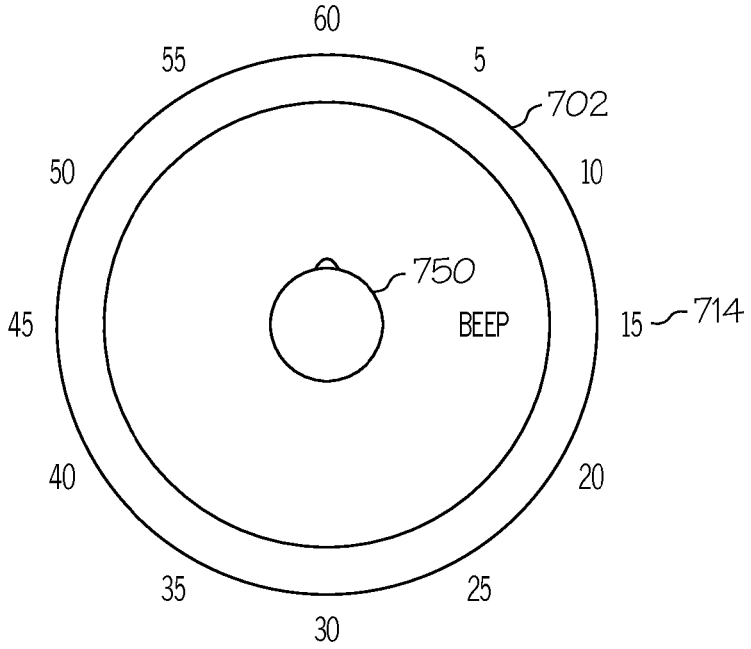
FIG. 7 illustrates sound localization in a 3D space using binaural sounds associated with another timer.

Concentric sound localization in a 3D space using binaural sounds to indicate time and calendar is further represented in FIG. 7. Shown is a position 714 associated with time before next meetings. Similarly, the number of minutes remaining before one's next meeting can also be represented with binaural sound.

Other metaphors are also possible. For example, when on a conference call, the voices of the other interlocutors on the call appear to be coming from different sources that are not collocated, just as if everyone was sitting around the same table. Each user in this example is associated with a separate call or channel. One method to record and playback a binaural sound is to first compute a set of head-related transfer functions (HRTF). More information on HRTF is available from online URL (http://en.wikipedia.org/wiki/Head-related_transfer_function), the teachings of which are hereby incorporated by reference in its entirety. In this case, each separate identified voice of a conference call attendee is mathematically convolved with the HRTF's of the user. The resulting sound localization has each attendee coming from a different direction. The real-time processing uses a DSP or other dedicated hardware on wireless communication device 100. These sound localizations, unlike other examples discussed, are created in real-time, rather than being stored.

Binaural sounds operate better if everything is calibrated for the user. This calibration includes, of course, a very precise model of the user's head and ears, but also a model of the headphones/earphones she/he is using, a model by which this type of calibration occurs at the point of sale. For instance, a user buys a new device and through a precise point-of-sale calibration session, a HRTF is captured and computed and stored on the wireless communication device 100. This HRTF model can be mathematically convolved real-time as in this conference call example, or off-line on other systems and stored on the device for other non-conference call examples.

The HRTF is a response that characterizes how an ear receives a sound from a point in space; a pair of HRTFs for two ears can be used to synthesize a binaural sound that seems to come from a particular point in space. Stated differently, the two ears of a human can locate sounds in three dimensions in range (distance), in direction above and below, in front and to the rear, as well as to either side. This is possible because the brain, inner ear and the external ears (pinna) work together to make inferences about location.

It is important to note that other examples to provide information to a user associated with time and calendars have been shown to be used advantageously with the sound localization in a 3D space using binaural sound.

Figure 8:
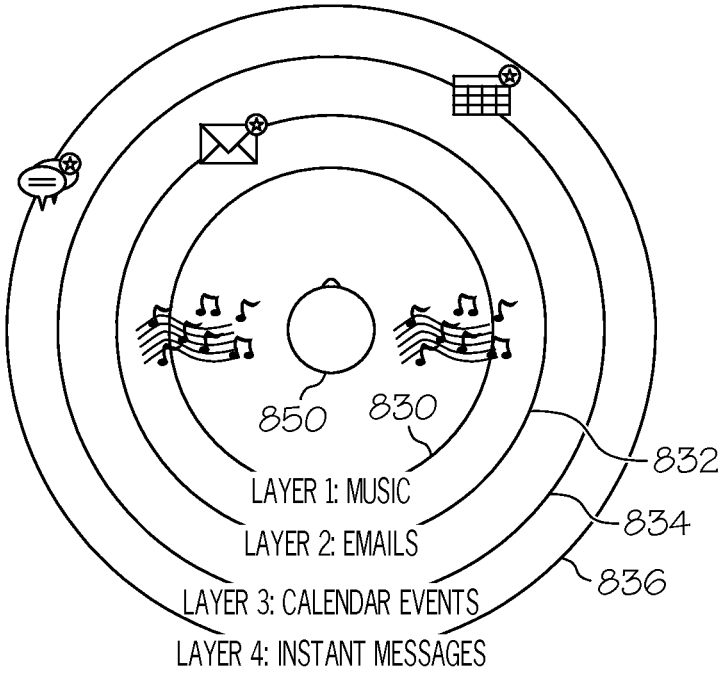
FIG. 8 illustrates sound localization in a 3D space using binaural sounds with layering, where each layer is associated to an individual source of information.

FIGS. 8-11 illustrate the concept of sound localization in a 3D space using binaural sounds with concentric layering around a user's head. Distance and direction of audio signal with respect to user is associated with information. The space around the user is divided into concentric regions or spheres of information. Shown in FIG. 8 are layers 830 created with sound localization in a 3D space using binaural sounds associated to an individual source of information. The layers shown are for music 830, emails 832, calendar events 834, and instant messages 836. In this example, the distance away from the user 850 projected with sound localization in a 3D space using binaural sounds is associated with a certain type or individual source of information.

Figure 9:
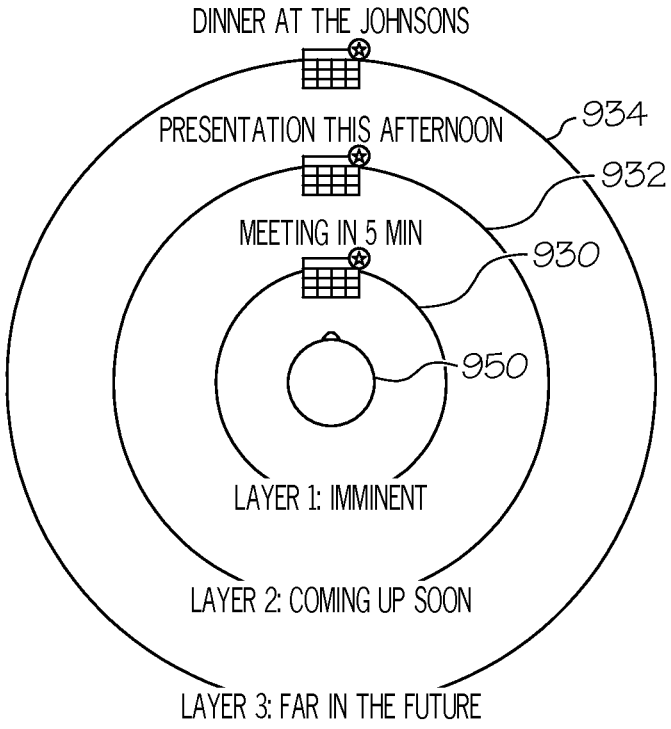
FIG. 9 illustrates sound localization in a 3D space using binaural sounds with layering, where each layer is associated to time.

FIG. 9 illustrates sound localization in a 3D space using binaural sounds with layering, where each layer is associated to time. In this example, there are different future periods of time—layer 1 "imminent in time" 930, layer 2 "coming up soon" 932, and layer 934 "far in the future". The distance away from the user 950 projected using binaural sound is related to time.

Figure 10:
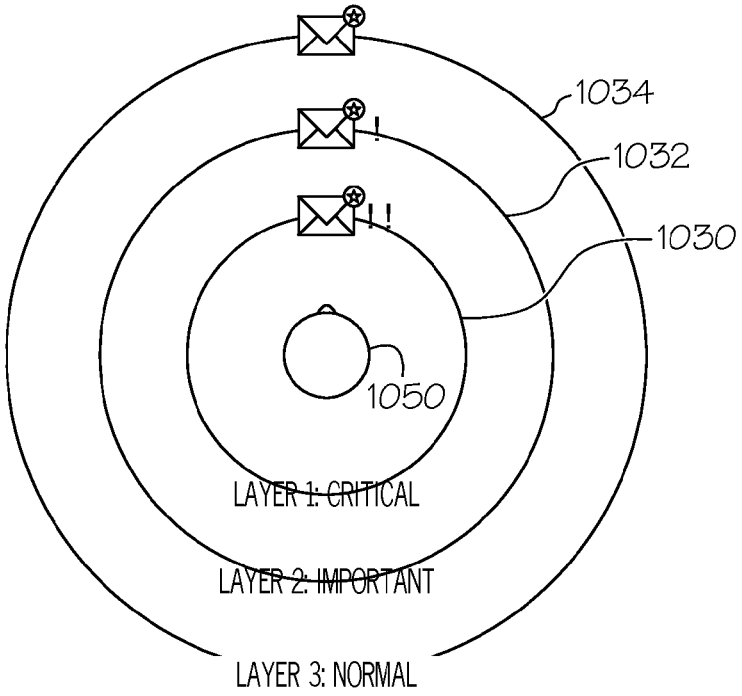
FIG. 10 illustrates sound localization in a 3D space using binaural sounds with layering, where each layer is associated to importance.

In another example, FIG. 10 illustrates the sound localization in a 3D space using binaural sounds with layering, where each layer is associated to importance. In this example, there are different layers of importance—layer 1030 "critical", layer 1032 "important" and layer 1034 "normal". The distance away from the user 1050 projected using binaural sound is associated with importance.

Figure 11:
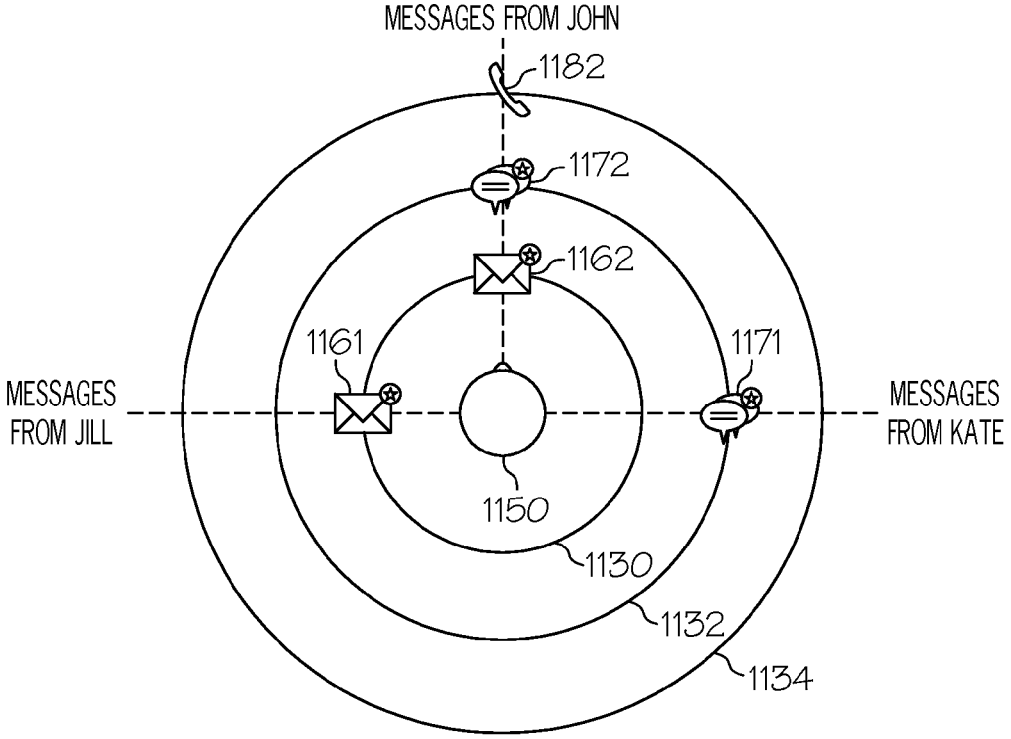
FIG. 11 illustrates sound localization in a 3D space using binaural sounds with layering, where each layer is a combination of an individual source of information and an individual sender of information.

In still another example, FIG. 11 illustrates sound localization in a 3D space using binaural sounds with layering, where each layer is a combination of an individual source of information along with an individual sender of the information. More specifically, layers are associated with type of information and each position in a layer with a person sending the information. Layer 1130 is email. Location 1161 is email from "Jill" and location 1162 is email from "John". Continuing further, layer 1132 is messaging to location 1172 from "John". Layer 1134 is telephone and location 1182 from "John". In this example both the distance and the location in a layer are associated with desired event information. Only a few examples of using sound localization of binaural sounds in a 3D space for position and/or layering to provide information to a user have been described, and many other combinations and possible applications are possible. For example, the location of a stationary or moving object described above, could be implemented in conjunction with these examples.

FIG. 12 shows one example of a table 1200 comprising various binaural sound presentation profiles that are used by the binaural presentation manager 104 for generating binaural sounds/actions for representing a set of application data 110. It should be noted that in the example of FIG. 12, each individual row in the table is a separate profile for a given type of application association comprising the attributes shown in the table. However, other configurations are also applicable as well. The table 1200 includes a first column 1202, entitled "Application Association", that comprises one or more entries that include an application, such as, battery power, wireless strength, time of day, meeting reminder, combined, calendar, email, messaging, telephone and more. For example, a first entry 1250 under this column 1202 comprises a "battery power" association. This corresponds to the linear gauge type of FIG. 5. The minimum or start position 1206, maximum or stop position 1208 may or may not be used. In this example, only a begin/end reference point of 12 noon being in "front" is being used. Layering is not currently used in columns 1212-1218 or an association with people in column 1220. The binaural sound source 1222 is one of several prerecorded sound sources.

A second row 1252 under this column 1202 is "wireless strength" association. This corresponds to circular gauge type of FIG. 4. The minimum or start position 1206 is 11 o'clock, and the maximum or stop position 1208 is 1 o'clock. The starting position 1206 is in front of the user. In situations, where the circular gauge is set up to play 360 degrees around the head of a user, no start and stop positions are necessary. An example of this type of association is a clock where each of the hours 1-12 forms a complete circle around the head of the user in 3D space. Again layering is not currently used in columns 1212-1218 or an association with people in column 1220. The binaural sound source 1222 is a prerecorded sound source.

A third row 1254 under this column 1202 is "time of day" association. This corresponds to circular gauge type of FIG. 3. The minimum or start position 1206 and the maximum or stop position 1208 are not currently used; rather "noon" as a circular starting position in column 1210 is needed. Again, layering is not currently used in columns 1212-1218 or an association with people in column 1220. The binaural sound source 1222 is one of several prerecorded sound sources.

A fourth row 1256 under this column 1202 is "meeting reminder" association. This corresponds to circular gauge type of FIG. 7. The minimum or start position 1206 and maximum or stop position 1208 are not currently used rather only a noon position in column 1210 is needed. Again layering is not currently used in columns 1212-1218 or an association with people in column 1220. The binaural sound source 1222 is a prerecorded sound source.

A fifth row 1258 under this column 1202 is "predictive search" or predictive text algorithm association. This corresponds to circular presentation of FIG. 3. The minimum or start position 1206, maximum or stop position 1208 are not currently used; rather only a noon position in column 1210 is needed. Again, layering is not currently used in columns 1212-1218 or an association with people in column 1220. However, notice that binaural sound source 1222 is using text-to-speech. In one example, words are read in real-time. A text-to-speech engine in this example produces binaural sounds rather than rely on binaural sound recordings. In this example, the text-to-speech engine is phonemes that are recorded using a binaural recording setup with a listener's nominal ear spacing and the shape of the user's ear to compute a HRTF.

In another example, a user's HRTFs is applied to a single generic recording of the word that is to be "displayed". For instance, referring to FIG. 3, a generic version of the word "bust" can be stored in memory on the device. When the predictive algorithm picks "bust" as a possible candidate that should be displayed to the left of the user, the recording can be mathematically convoluted with the HRTFs that will make the recording sound like it comes from the left.

A sixth row 1260 under this column 1202 is "combined" association. This corresponds to circular presentation of FIG. 8, where each layer is associated with a type or source of a message. The minimum or start position 1206, maximum or stop position 1208 are not currently used; rather only a noon position in column 1210 is needed. Layer 1 1214 is used for music, layer 2 1216 is used for email, and layer 3 1218 is used for messaging. An association to particular people is not currently used in column 1220. The binaural sound source 1222 is a prerecorded sound source.

A seventh row 1262 under this column 1202 is "calendar" association. This corresponds to circular presentation of FIG. 9, where each layer is associated with a time. The minimum or start position 1206, maximum or stop position 1208 are not currently used; rather only a noon position in column 1210 is needed. Layer 1 1214 is being used for "imminent", layer 2 1216 is being used for "soon", and layer 3 1218 being used for "future". An association to particular people is not currently used in column 1220. The binaural sound source 1222 is a prerecorded sound source.

An eighth row 1264 under this column 1202 is "messaging" association. This corresponds to circular presentation of FIG. 10, where each layer is associated with importance. The minimum or start position 1206, maximum or stop position 1208 are not currently used; rather only a noon position in column 1210 is needed. Layer 1 1214 is being used for "critical", layer 2 1216 is being used for "important", and layer 3 1218 being used for "normal". An association to particular people is not currently used in column 1220. The binaural sound source 1222 is a prerecorded sound source.

The ninth, tenth, eleventh, twelfth, thirteenth and fourteenth rows 1266-1276 under this column 1202 are all used in conjunction to illustrate a profile of both a combination of source of information and sender of information. This corresponds to circular presentation of FIG. 11, where each layer is associated with both a source of information and sender of information. The particular entries and combinations are settable. For example in row 1266, email association in column 1202 are set to layer 1, where the emails from the sender "John" are set to 12 noon. The other entries are self-explanatory to those of average skill in the art, in light of the previous examples.

It is important to note that table 1200 of FIG. 12 is an example of different types of binaural presentation settings that are possible with sound localization in a 3D space using binaural sounds. In other examples, additional combinations and permutations are possible. Moreover, various non-visual sensory events can be used to represent various types of information. These non-visual sensory events are advantageous because they can be used to provide a short overview or preview of the information in an unobtrusive non-visual manner that can be easily understood by the user. The use of sound localization in a 3D space using binaural sounds provides ambient global information to the user in an unobtrusive way. Stated differently, the binaural presentation manager 104 provides information to a user that can be processed in a conscience or subconscious way.

The binaural presentation manager 104 uses the binaural presentation profiles 112 to generate a sequence of binaural sensory events that provide sound localization in a 3D space using binaural sounds. For example, when the user of the device 100 opens an application 108 such as an email application, the application data analyzer 116 of the manager 104 analyzes the application data 110 such as email messages in an inbox. Alternatively, the process for non-visually representing information to a user can be initiated by the user placing a pointer over an icon without clicking the icon. The profile analyzer 114 of the manager 104 then identifies a set of profiles 112 such as those shown in FIG. 12 associated with email messages. The profile analyzer 114 then compares and matches the information in the identified profiles 112 to the corresponding data in the application data 110. As discussed above, these profiles 112 comprise a set of binaural types/categories of events that are associated with a given application data item. The binaural event generator 118, based on this comparison and matching, generates a sound localization in a 3D space using binaural sounds that represent the application data 110. The manager 104 then performs this sequence of binaural sensory events to provide the user with an overview or preview of the application data/information 110.

Overall Process Flow

Figure 13:
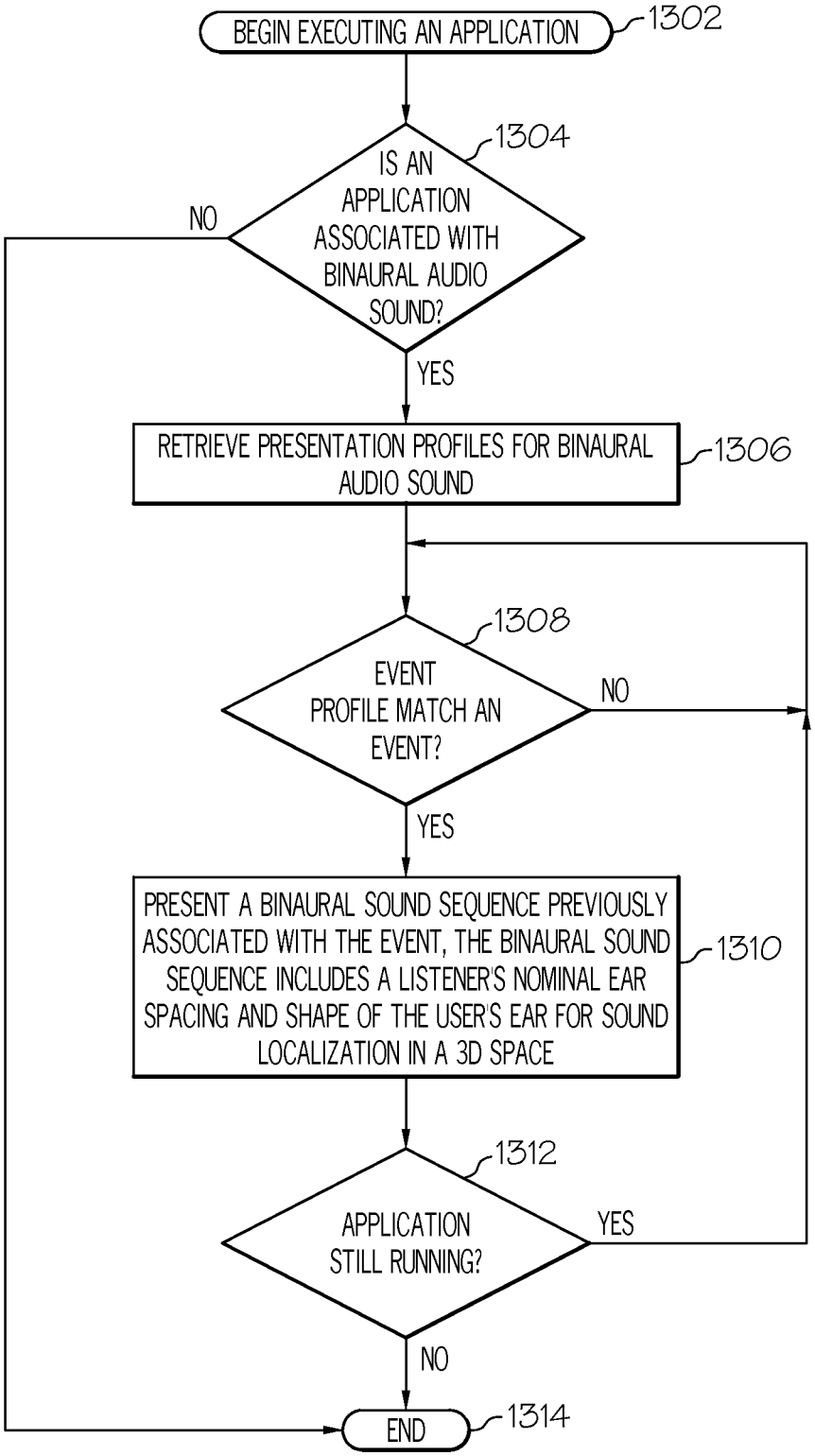
FIG. 13 is a flow diagram of sound localization in a 3D space using binaural sounds that represent the application data.

FIG. 13 is a flow diagram for a sound localization in a 3D space using binaural sounds that represent the application data. The process begins in step 1302 when an application begins executing. A test is made in step 1304 to determine if there is an association with binaural audio sound such as shown in the table 1200 of FIG. 12. In the case where the application is not associated with a binaural sound, the process ends in step 1304. In response to the application previously being associated with an application, the presentation profiles, such as those in table 1200 for binaural sound are retrieved in step 1306. When an event is matched in the table 1200 with an application, binaural sound is presented in step 1310. Typically, other than text-to-speech or real-time filter, the binaural sound has been previously associated with the event to include the listener's or user's nominal ear spacing for sound localization in 3D space. A test is made in step 1312 to determine if the application is still executing or running. The process flow loops back to step 1308 until the application is finished executing and exits in step 1314.

Example Electronic Device

Figure 14:
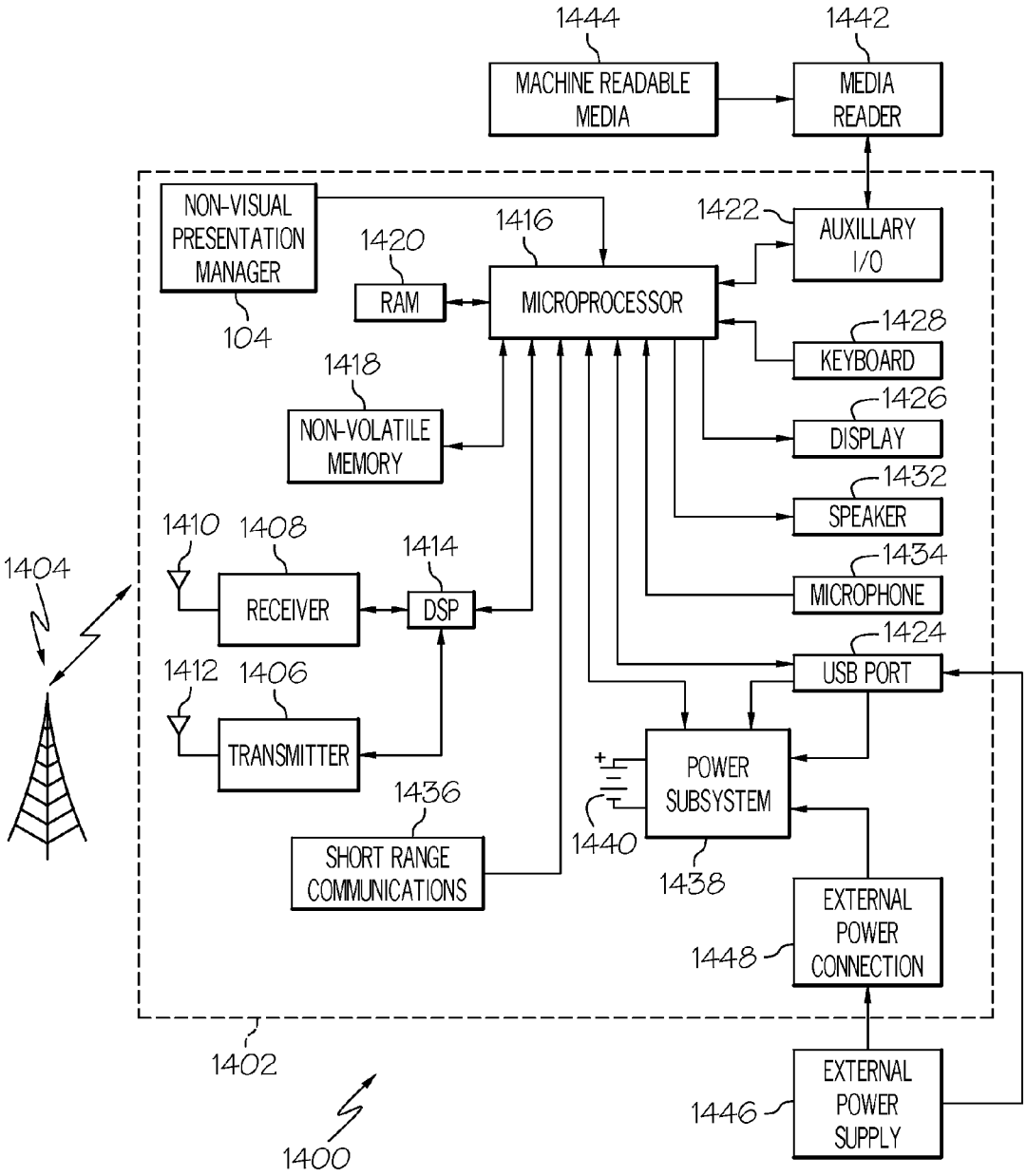
FIG. 14 is a block diagram of an electronic device and associated components in which the systems and methods disclosed herein may be implemented.

FIG. 14 is a block diagram of an electronic device and associated components 1400 in which the systems and methods disclosed herein may be implemented. In this example, an electronic device 1402, such as wireless communication device 100, is a wireless two-way communication device with voice and data communication capabilities. Such electronic devices communicate with a wireless voice or data network 1404 using a suitable wireless communications protocol. Wireless voice communications are performed using either an analog or digital wireless communication channel. Data communications allow the electronic device 1402 to communicate with other computer systems via the Internet. Examples of electronic devices that are able to incorporate the above described systems and methods include, for example, a data messaging device, a two-way pager, a cellular telephone with data messaging capabilities, a wireless Internet appliance or a data communication device that may or may not include telephony capabilities.

The illustrated electronic device 1402 is an example electronic device that includes two-way wireless communications functions. Such electronic devices incorporate communication subsystem elements such as a wireless transmitter 1406, a wireless receiver 1408, and associated components such as one or more antenna elements 1410 and 1412. A digital signal processor (DSP) 1414 performs processing to extract data from received wireless signals and to generate signals to be transmitted. The particular design of the communication subsystem is dependent upon the communication network and associated wireless communications protocols with which the device is intended to operate.

The electronic device 1402 includes a microprocessor 1416 that controls the overall operation of the electronic device 1402 and communicates with other processing circuits. The microprocessor 1416 interacts with the above described communications subsystem elements and also interacts with other device subsystems such as non-volatile memory 1418 and random access memory (RAM) 1420. The non-volatile memory 1418 and RAM 1420 in one example contain program memory and data memory, respectively. The microprocessor 1416 also interacts with the binaural presentation manager 104 and its components, an auxiliary input/output (I/O) device 1422, a Universal Serial Bus (USB) Port 1424, a display 1426, a keyboard 1428, a speaker 1432, a microphone 1434, a short-range communications subsystem 1436, a power subsystem 1438, and any other device subsystems.

A battery 1440 is connected to a power subsystem 1438 to provide power to the circuits of the electronic device 1402. The power subsystem 1438 includes power distribution circuitry for providing power to the electronic device 1402 and also contains battery charging circuitry to manage recharging the battery 1440. The power subsystem 1438 includes a battery monitoring circuit that is operable to provide a status of one or more battery status indicators, such as remaining capacity, temperature, voltage, electrical current consumption, and the like, to various components of the electronic device 1402. An external power supply 1446 is able to be connected to an external power connection 1448.

The USB port 1424 further provides data communication between the electronic device 1402 and one or more external devices. Data communication through USB port 1424 enables a user to set preferences through the external device or through a software application and extends the capabilities of the device by enabling information or software exchange through direct connections between the electronic device 1402 and external data sources rather than via a wireless data communication network.

Operating system software used by the microprocessor 1416 is stored in non-volatile memory 1418. Further examples are able to use a battery backed-up RAM or other non-volatile storage data elements to store operating systems, other executable programs, or both. The operating system software, device application software, or parts thereof, are able to be temporarily loaded into volatile data storage such as RAM 1420. Data received via wireless communication signals or through wired communications are also able to be stored to RAM 1420. As an example, a computer executable program configured to perform the binaural presentation manager 104, described above, is included in a software module stored in non-volatile memory 1418.

The microprocessor 1416, in addition to its operating system functions, is able to execute software applications on the electronic device 1402. A predetermined set of applications that control basic device operations, including at least data and voice communication applications, is able to be installed on the electronic device 1402 during manufacture. Examples of applications that are able to be loaded onto the device may be a personal information manager (PIM) application having the ability to organize and manage data items relating to the device user, such as, but not limited to, e-mail, calendar events, voice mails, appointments, and task items. Further applications include applications that have input cells that receive data from a user.

Further applications may also be loaded onto the electronic device 1402 through, for example, the wireless network 1404, an auxiliary I/O device 1422 that include an audio interface for coupling with headphones/earphones, USB port 1424, short-range communications subsystem 1436, or any combination of these interfaces. Such applications are then able to be installed by a user in the RAM 1420 or a non-volatile store for execution by the microprocessor 1416.

In a data communication mode, a received signal such as a text message or web page download is processed by the communication subsystem, including wireless receiver 1408 and wireless transmitter 1406, and communicated data is provided the microprocessor 1416, which is able to further process the received data for output to the display 1426, or alternatively, to an auxiliary I/O device 1422 or the USB port 1424. A user of the electronic device 1402 may also compose data items, such as e-mail messages, using the keyboard 1428, which is able to include a complete alphanumeric keyboard or a telephone-type keypad, in conjunction with the display 1426 and possibly an auxiliary I/O device 1422. Such composed items are then able to be transmitted over a communication network through the communication subsystem.

For voice communications, overall operation of the electronic device 1402 is substantially similar, except that received signals are generally provided to a speaker 1432 and signals for transmission are generally produced by a microphone 1434. Alternative voice or audio I/O subsystems, such as a voice message recording subsystem, may also be implemented on the electronic device 1402. Although voice or audio signal output is generally accomplished primarily through the speaker 1432, the display 1426 may also be used to provide an indication of the identity of a calling party, the duration of a voice call, or other voice call related information, for example.

Depending on conditions or statuses of the electronic device 1402, one or more particular functions associated with a subsystem circuit may be disabled, or an entire subsystem circuit may be disabled. For example, if the battery temperature is low, then voice functions may be disabled, but data communications, such as e-mail, may still be enabled over the communication subsystem.

A short-range communications subsystem 1436 is a further optional component which may provide for communication between the electronic device 1402 and different systems or devices, which need not necessarily be similar devices. For example, the short-range communications subsystem 1436 may include an infrared device and associated circuits and components or a Radio Frequency based communication module such as one supporting Bluetooth® communications, to provide for communication with similarly-enabled systems and devices. The short range-communication system 1436, in one example, wireless transmits audio to a user's headphone/earphone.

A media reader 1442 is able to be connected to an auxiliary I/O device 1422 to allow, for example, loading computer readable program code of a computer program product into the electronic device 1402 for storage into non-volatile memory 1418. In one example, computer readable program code includes instructions for performing the pressure detecting user input device operating process 1400, described above. One example of a media reader 1442 is an optical drive such as a CD/DVD drive, which may be used to store data to and read data from a computer readable medium or storage product such as computer readable storage media 1444. Examples of suitable computer readable storage media include optical storage media such as a CD or DVD, magnetic media, or any other suitable data storage device. Media reader 1442 is alternatively able to be connected to the electronic device through the USB port 1424 or computer readable program code is alternatively able to be provided to the electronic device 1402 through the wireless network 1404.

The present subject matter can be realized in hardware, software, or a combination of hardware and software. A system can be realized in a centralized fashion in one computer system, or in a distributed fashion where different elements are spread across several interconnected computer systems. Any kind of computer system—or other apparatus adapted for carrying out the methods described herein—is suitable. A typical combination of hardware and software could be a general purpose computer system with a computer program that, when being loaded and executed, controls the computer system such that it carries out the methods described herein.

The present subject matter can also be embedded in a computer program product, which comprises all the features enabling the implementation of the methods described herein, and which—when loaded in a computer system—is able to carry out these methods. Computer program in the present context means any expression, in any language, code or notation, of a set of instructions intended to cause a system having an information processing capability to perform a particular function either directly or after either or both of the following a) conversion to another language, code or, notation; and b) reproduction in a different material form.

Each computer system may include, inter alia, one or more computers and at least a computer readable medium allowing a computer to read data, instructions, messages or message packets, and other computer readable information from the computer readable medium. The computer readable medium may include computer readable storage medium embodying non-volatile memory, such as read-only memory (ROM), flash memory, disk drive memory, CD-ROM, and other permanent storage. Additionally, a computer medium may include volatile storage such as RAM, buffers, cache memory, and network circuits.

Although specific examples of the subject matter have been disclosed, those having ordinary skill in the art will understand that changes can be made to the specific examples without departing from the spirit and scope of the disclosed subject matter. The scope of the disclosure is not to be restricted, therefore, to the specific examples, and it is intended that the appended claims cover any and all such applications, modifications, and examples within the scope of the present disclosure.

What is claimed is:

1. A method on an electronic device comprising:

receiving an informational event;

determining if the informational event has been previously associated with a binaural sound sequence, the binaural sound sequence including a nominal ear spacing and ear shape of a particular user for sound localization in a 3D space; and sending the binaural sound sequence defining separate localized points creating a gauge in the 3D space with i) a minimum value, ii) a maximum value, and iii) at least one value for the informational event through a multimedia port, in response to the binaural sound sequence being previously associated with the informational event.

2. The method of claim 1, wherein the informational event is a set of words presented by a predictive search algorithm, the binaural sound sequence is a sequence of words representing search results of the predictive search algorithm, and the sending the binaural sound sequence includes sending each word in the set of words separately as a localized distinct point within the gauge in the 3D space.

3. The method of claim 1, wherein the informational event is associated with a measured value.

4. The method of claim 1, wherein the informational event is a measured value and the binaural sound sequence is localized between the minimum value and the maximum value substantially along a concentric region surrounding the user within the 3D space.

5. The method of claim 4, wherein the measured value is associated with at least one of:

a battery level;

a wireless signal strength;

a volume;

a display setting;

processor usage;

storage usage; and memory usage.

6. The method of claim 1, wherein the informational event is at least one of a calendar event and a time event, and the binaural sound sequence is localized substantially along a concentric region surrounding a head of the user within the 3D space.

7. The method of claim 1, wherein the binaural sound sequence is localized substantially along at least two concentric regions each at different distances from the user and each surrounding the user within the 3D space.

8. The method of claim 7, wherein each of the concentric regions represents a different level of importance previously associated with the event.

9. The method of claim 7, wherein each of the concentric regions represents a different future period of time associated with the event.

10. The method of claim 7, wherein each of the concentric regions represents a different source for the event.

11. The method of claim 7, wherein each of the concentric regions represents a different individual sender of information associated with the event.

12. The method of claim 2, further comprising:

receiving a selection of a word from the set of words after the binaural sound sequence is sent through the multimedia port.

13. An electronic device, the electronic device comprising:

a memory;

a processor communicatively coupled to the memory; and a binaural presentation manager communicatively coupled to the memory and the processor, the binaural presentation manager configured to perform:

receiving an informational event;

determining if the informational event has been previously associated with a binaural sound sequence, the binaural sound sequence including a nominal ear spacing and ear shape of a particular user ear for sound localization in a 3D space; and sending the binaural sound sequence defining separate localized points creating a gauge in the 3D space with i) a minimum value, ii) a maximum value, and iii) at least one value for the informational event through a multimedia port, in response to the binaural sound sequence being previously associated with the informational event.

14. The electronic device of claim 13, wherein the informational event is a set of words presented by a predictive search algorithm, the binaural sound sequence is a sequence of words representing search results of the predictive search algorithm, and the sending the binaural sound sequence includes sending each word in the set of words separately as a localized distinct point within the gauge in the 3D space.

15. The electronic device of claim 13, wherein the informational event is associated with a measured value.

16. The electronic device of claim 13, wherein the informational event is a measured value.

17. The electronic device of claim 16, wherein the measured value is associated with at least one of:

a battery level;

a wireless signal strength;

a volume;

a display setting;

processor usage;

storage usage; and memory usage.

18. A computer program product comprising:

a non-transitory storage medium readable by a processing circuit and storing instructions for execution by the processing circuit configured to perform:

receiving an informational event;

determining if the informational event has been previously associated with a binaural sound sequence, the binaural sound sequence including a nominal ear spacing and ear shape of a particular user's ear for sound localization in a 3D space; and sending the binaural sound sequence defining separate localized points creating a gauge in the 3D space with i) a minimum value, ii) a maximum value, and iii) at least one value for the informational event through a multimedia port, in response to the binaural sound sequence being previously associated with the informational event.

19. The computer program product of claim 18, wherein the informational event is associated with a measured value.

20. The computer program product of claim 18, wherein the informational event is a measured value and the binaural sound sequence is localized between the minimum value and the maximum value substantially along a concentric region surrounding the user within the 3D space.

* * * * *